US005773737A

United States Patent [19]

Reyburn

[11] Patent Number: 5,773,737

[45] Date of Patent: Jun. 30, 1998

[54] VISUAL DISPLAY FOR DIGITAL AURAL MUSICAL INSTRUMENT TUNING

[75] Inventor: Dean Laurence Reyburn, Cedar Springs, Mich.

[73] Assignee: Reyburn Piano Service, Inc., Cedar Springs, Mich.

[21] Appl. No.: 872,022

[22] Filed: Jun. 10, 1997

Related U.S. Application Data

[62] Division of Ser. No. 663,653, Jun. 14, 1996, Pat. No. 5,719,343.

[51] Int. Cl.[6] ..... G10G 7/02

[52] U.S. Cl. ..... 84/454; 84/477 R

[58] Field of Search ..... 84/454, 477 R

[56] References Cited

U.S. PATENT DOCUMENTS 3,876,936 4/1975 Lester et al. ..... 324/76.41
3,952,625 4/1976 Peterson ..... 84/454

OTHER PUBLICATIONS

KORG KORG Inc., Auto Chromatic Tuner Accordeur Automatique DT–3 Owner's manual Notice D'Emploi (enclosed).

*Primary Examiner*—Michael L. Gellner
*Assistant Examiner*—Shih-yung Hsieh
*Attorney, Agent, or Firm*—Killworth, Gottman, Hagan & Schaeff, L.L.P.

[57] ABSTRACT

Methods and apparatus determine tuning frequencies for an instrument, such as a piano, by sounding at least three musical notes of the instrument. The sounded notes are recorded and digitally filtered to generate directly partial ladders representative of the sounded notes. The partial ladders are equalized with respective to a reference frequency or one another to determine tuning frequencies for the sounded notes. Tuning frequencies for the remaining notes of the instrument are then determined from the equalized partial ladders. Tone generators which produce the musical notes, such as strings on a piano, are then adjusted to conform the musical notes which they generate to the tuning frequencies. Preferably, the tone generators are adjusted using a display which provides highly accurate macro and micro tuning information in a single display by graphically and dynamically displaying pitch differences of the musical notes generated by the tone generators relative to pitches of the tuning frequencies. Reference to the display facilitates adjustment of the tone generators to make the pitch differences substantially zero. Automatically note switching is preferably performed as is pitch raise tuning using a table of pitch raise overpull percentages for the musical notes of an instrument to be tuned.

28 Claims, 7 Drawing Sheets

| | | | | | |
|---|---|---|---|---|---|
| | 8 | | | | |
| | 7 | | | | |
| | 6 | 6 | | | |
| PARTIAL NUMBER | 4 | 4 | 4 | 4 | 4 |
| | | 3 | 3 | 3 | 3 |
| | | 2 | 2 | 2 | 2 |
| | | | 1 | 1 | 1 |
| NOTE: | A1 | A2 | A3 | A4 | A5 |

VISUAL DISPLAY FOR DIGITAL AURAL MUSICAL INSTRUMENT TUNING

This is a division of application Ser. No. 08/663,653 filed Jun. 14, 1996, now U.S. Pat. No. 5,719,343.

BACKGROUND OF THE INVENTION

The present invention relates in general to tuning musical instruments and, more particularly, to digital aural tuning of musical instruments having a plurality of adjustable frequency tone generators, such as strings in pianos, for generating a like plurality of musical notes. While the present invention is generally applicable to a variety of musical instruments including, for example, harpsichords, organs and pianos, it will be described herein with reference to tuning pianos for which it is particularly applicable and initially being applied.

Aural tuning techniques have been used to tune pianos since the earliest introduction of these instruments in the seventeen hundreds. In conventional aural tuning, a human tuner listens to a reference note and adjusts another note of the piano until that note sounds consonant with the reference note. Consonance can be indicated by a specified beat rate between the note being tuned and the reference note. Beat rate tuning is possible because an equally tempered scale is based upon simple mathematical relationships. In actuality, the frequencies which make up given notes of a piano and other instruments, do not correspond exactly to simple mathematic relationships.

For example, while "harmonics" denote integer multiples of a base frequency of a musical note, the overtones actually produced by a piano string are not harmonics and, to distinguish the overtones from harmonics, are called "partials". Each note of a piano includes a plurality of partials which are referred to as a "partial ladder" which can be used to represent all partials of a note or at least all partials which are required to tune an instrument. Partial ladders can be the relative pitches of the included partials for a note; however, more commonly they are listed as the deviation of the included partials from their corresponding harmonics and are quantified in "cents" where one cent is the amount of pitch difference that is equal to one per cent (0.01) of a semitone.

The difference between a given partial and its ideal harmonic is caused in part by "inharmonicity" which causes the partials of a vibrating piano string to be sharper or higher in frequency than would be expected from the harmonics for the string. Inharmonicity is due to the inherent stiffness of the metal wire which makes up the strings. While the inharmonicity theory presumes that all partials of a vibrating piano string are sharper than expected, in most instances, the partials may be either sharper, i.e., higher in frequency, or flatter, i.e., lower in frequency, than would be predicted by inharmonicity. This phenomenon, which is not accounted for by the inharmonicity theory and is believed to be due to the construction of the instrument, is referred to herein as "para-harmonicity". Every string or note of a piano can have a unique partial structure or partial ladder. To add to the complexity, each piano is different and even two pianos which are made side-by-side will require slightly different tuning or pitch for at least some and more often many of the notes of the pianos.

While manual aural tuning is the standard and produces excellent results, it is much more of an art than a science requiring substantial training of highly skilled and experienced persons. Further, manual aural tunings can vary from tuner to tuner and the manual aural tuning process can take a substantial amount of time. To reduce tuning time and the level of skill required for tuning instruments, other tuning techniques, such as tuning calculations, have been proposed. The concept of calculating a theoretical tuning for a piano has been known for many years, and was addressed widely in the Piano Technician's Journal and other publications throughout the 1970's and 1980's.

The tuning calculations revolved around creating a perfect tuning using theoretical models. Unfortunately, the calculation techniques have not proven to be satisfactory since the calculations are very complex and the results do not match aural tuning results.

To improve upon the calculation techniques, measurement methods for determining the pitches of partials for the notes of an instrument to be tuned have been explored. One of the earliest attempts measured the difference between two partials of one note in the middle of the piano to determine the inharmonicity of the instrument. Unfortunately, the note chosen may or may not be representative of the notes around it and the measurements are time consuming and often inaccurate. This method is referred to as the partial-pair measurement method.

Another technique uses a calculated "inharmonicity constant" (Ic) which is derived from a physical measurement of the length and diameter of a vibrating string. This technique is referred to as the scale measurement method. Once the Ic is determined, equations including the Ic are used to calculate the partial structure for the notes of an instrument. A series of equations for calculating a tuning for 88 piano notes using an Ic were published in July, 1990 and further documented in the Piano Technician's Journal in 1991–1992. Unfortunately, this method requires scale measurements which normally take more time than the average aural tuner requires, around 2 hours, making it impractical.

Another scale measurement method is used in a product available from the inventor of the present application and sold under the trademark "Chameleon". In Chameleon, now Chameleon 1, the physical characteristics of five strings are measured to derive an Ic and then to calculate an 88 note tuning based on the Ic and equations which are somewhat simplified when compared to the equations found in the Piano Technician's Journal in 1991–1992.

Another technique measures the inharmonicity between two partials on each of three notes and calculates an 88 note tuning. This technique is an expansion of the partial-pair method mentioned above. Because the F, A and C notes are commonly used, this method is also referred to as the "FAC" method and is more fully described in U.S. Pat. No. 5,285,711. In this patent, the calculation of the 88 note tuning is performed using equations which rely on the Ic. The equations are either directly solved or utilized to prepare look-up tables which reduce the computing power required by a system embodying the invention. In either event, the calculations rely upon solution of the equations disclosed in the patent.

Unfortunately, all of the above methods presume that the inharmonicity theory is inviolate and that the inharmonicity constant (Ic) is accurately calculated by standard formulae, neither of which is true. The scale measurement methods use one of several standard formulae to convert wire type, diameter, and length into an inharmonicity constant (Ic). The partial-pair measurement methods use two measured partials of one or more notes, such as three notes, to calculate the inharmonicity constant with standard formulae. In either case, the inharmonicity constant determined is either not accurate or is not accurate for the entire instrument being tuned due, for example, to a failure to consider para-harmonicity.

Applicant's experience and research in aural, electronic measurement and calculated tuning has shown that the prior art tuning methods, while able to produce tunings that are acceptable to some tuners and musicians, are inadequate to produce tunings that rival the best aural human tuners. Expert aural tuners can detect pitch changes of as little as one-thousandth of a semitone, i.e., 0.1 cent again where one cent is the amount of pitch difference that is equal to one per cent (0.01) of a semitone. Such tuning precision is not within the capabilities of prior art techniques. Thus, if an expert aural human tuner is given enough time, he can produce a tuning that excels even the best prior art electronic or calculated tuning.

Accordingly, there is a need for an improved tuning method which can produce improved tuning results when compared to prior art methods. Preferably, the improved tuning method would not only produce improved instrument tunings but also would permit persons of less skill and experience than an expert aural tuner to produce improved instrument tunings in less time than either an expert aural tuner or a tuner using prior art tuning techniques. The tuning method would be further improved by use of an improved graphic and dynamic display of a pitch difference of an unknown pitch relative to a desired pitch which would provide highly accurate macro and micro tuning information in a single display.

SUMMARY OF THE INVENTION

This need is met by the methods and apparatus of the present invention wherein at least three musical notes of an instrument are sounded and recorded to generate directly partial ladders representative of the sounded notes. The partial ladders are equalized with respective to a reference frequency or one another to determine tuning frequencies for the sounded notes. Tuning frequencies for the remaining notes of the instrument are then determined from the equalized partial ladders. Tone generators, such as strings on a piano, are then adjusted to conform the musical notes which they generate to the tuning frequencies. Preferably, the tone generators are adjusted using a display which provides highly accurate macro and micro tuning information in a single display by graphically and dynamically displaying pitch differences of the musical notes generated by the tone generators relative to pitches of the tuning frequencies. Reference to the display facilitates adjustment of the tone generators to make the pitch differences substantially zero.

In accordance with one aspect of the present invention, a method for tuning a musical instrument having a plurality of adjustable frequency tone generators for generating a like plurality of musical notes, each tone generator producing a plurality of different order partials with the first partial for each note corresponding to the lowest frequency of the note comprises the steps of: digitally recording a partial ladder for at least three musical notes produced by at least three corresponding adjustable frequency tone generators of the musical instrument, the partial ladders including all partials needed to tune the musical instrument; equalizing the partial ladders to determine tuning frequencies for each of the at least three musical notes; determining tuning frequencies for musical notes of the musical instrument from equalized partial ladders; and, adjusting the plurality of adjustable frequency tone generators to conform their musical notes to the tuning frequencies.

Preferably, the step of adjusting the plurality of adjustable frequency tone generators comprises the step of graphically and dynamically displaying pitch differences of the musical notes of the adjustable frequency tone generators relative to pitches of the tuning frequencies until the pitch difference is displayed as being substantially zero.

In accordance with another aspect of the present invention, a method for tuning a musical instrument having a plurality of adjustable frequency tone generators for generating a like plurality of musical notes, each tone generator producing a plurality of different order partials with the first partial for each note corresponding to the lowest frequency of the note comprises the steps of: digitally recording a partial ladder for at least three musical notes produced by at least three corresponding adjustable frequency tone generators of the musical instrument, the partial ladders including all partials needed to tune the musical instrument; equalizing one of the partial ladders as a starting partial ladder; equalizing the remaining partial ladders with respect to the starting partial ladder; calculating digital tuning frequencies for the remaining notes of the plurality of musical notes from equalized partial ladders of the at least three musical notes; and, adjusting the plurality of adjustable frequency tone generators to conform their musical notes to the tuning frequencies.

In accordance with still another aspect of the present invention, a method for tuning a musical instrument having a plurality of adjustable frequency tone generators for generating a like plurality of musical notes, each tone generator producing a plurality of different order partials with the first partial for each note corresponding to the lowest frequency of the note comprises the steps of: digitally recording a partial ladder for at least three musical notes produced by at least three corresponding adjustable frequency tone generators of the musical instrument, the partial ladders including all partials needed to tune the musical instrument; equalizing a first partial ladder as a starting partial ladder by setting one partial of the starting partial ladder equal to a nominal frequency for the one partial and adjusting all other partials of the starting partial ladder relative to the one partial; equalizing a second partial ladder relative to the starting partial ladder by setting one partial of the second partial ladder to a corresponding partial of the starting partial ladder less a widening offset; equalizing a third partial ladder relative to the starting partial ladder or the second partial ladder by setting one partial of the third partial ladder to a corresponding partial in the starting partial ladder or the second partial ladder less a widening offset; calculating tuning frequencies for the remaining notes of the plurality of musical notes from equalized partial ladders of the at least three musical notes; and, adjusting the plurality of adjustable frequency tone generators to conform their musical notes to the tuning frequencies.

In accordance with yet another aspect of the present invention, apparatus for tuning a musical instrument having a plurality of adjustable frequency tone generators for generating a like plurality of musical notes, each tone generator producing a plurality of different order partials with the first partial for each note corresponding to the lowest frequency of the note comprises recorder means for digitally recording a partial ladder for at least three musical notes produced by at least three corresponding adjustable frequency tone generators of the musical instrument. The partial ladders include all partials needed to tune the musical instrument. Equalizer means provide for equalizing the partial ladders to determine tuning frequencies for each of the at least three musical notes. Means are provided for determining tuning frequencies for musical notes of the musical instrument from equalized partial ladders.

Preferably, the apparatus for tuning a musical instrument further comprises display means for graphically and dynamically displaying pitch differences of the musical notes of the adjustable frequency tone generators relative to pitches of the tuning frequencies.

In accordance with an additional aspect of the present invention, a method for graphically and dynamically displaying a pitch difference of an unknown pitch relative to a desired pitch comprises the steps of: determining an unknown pitch; comparing the unknown pitch to a desired pitch to determine a pitch difference; displaying a spinner at a center of a display if the pitch difference is within a first defined pitch window relative to the desired pitch; maintaining the spinner stationary if the pitch difference is equal to zero; rotating the spinner clockwise if the pitch difference is greater than zero but less than an upper boundary of the first defined pitch window; rotating the spinner counterclockwise if the pitch difference is less than zero but greater that a lower boundary of the first defined pitch window; setting the rate of rotation in proportion to the extent the unknown pitch is different than zero; moving the spinner in a first direction off of the center if the pitch difference exceeds the upper boundary of the first defined pitch window; moving the spinner in a second direction off the center if the pitch difference exceeds the lower boundary of the first defined pitch window; and, setting the amount of movement of the spinner proportional to the extent the unknown pitch exceeds the upper and lower boundaries of the first defined pitch window. The method for graphically and dynamically displaying a pitch difference may further comprise the step of modifying the spinner toward a solid image as the unknown pitch increasingly exceeds the upper and lower boundaries of the first pitch window.

In accordance with yet an additional aspect of the present invention, a method for automatically switching notes in an electronic instrument tuning device comprises the steps of: defining a current note; sounding a note which can be the current note or a note adjacent to the current note; determining the pitch difference of a sounded note relative to the current note; using the next higher note if the pitch difference is greater than a defined first pitch difference; using the next lower note if the pitch difference is less than a defined second pitch difference; and, using the current note if the pitch difference is within a current pitch difference window between the second pitch difference and the first pitch difference.

In accordance with still an additional aspect of the present invention, a method for pitch raise tuning comprises the steps of: setting up a table of pitch raise overpull percentages for the musical notes of an instrument to be tuned; and, using the table of pitch raise overpull percentages to determine pitch raise tuning frequencies for musical notes of an instrument to be tuned.

It is, thus, an object of the present invention to provide improved methods and apparatus for digital aural tuning of musical instruments having a plurality of adjustable tone generators; to provide improved methods and apparatus for digital aural tuning of musical instruments having a plurality of adjustable tone generators by digitally recording musical notes sounded by at least three of the generators and determining and recording partial ladders for the notes recorded which are then used for tuning the instruments; to provide improved methods and apparatus for digital aural tuning of musical instruments having a plurality of adjustable tone generators including a display which provides highly accurate macro and micro tuning information in a single display by graphically and dynamically displaying pitch differences of musical notes generated by the tone generators relative to pitches of determined tuning frequencies; to provide improved methods and apparatus for digital aural tuning of musical instruments having a plurality of adjustable tone generators including automatic note switching; and, to provide improved methods and apparatus for digital aural tuning of musical instruments having a plurality of adjustable tone generators wherein the tuning provides for pitch raise tuning using a table of pitch raise overpull percentages for the musical notes of an instrument to be tuned to determine pitch raise tuning frequencies for musical notes of the instrument to be tuned.

Other objects and advantages of the invention will be apparent from the following description, the accompanying drawings and the appended claims.

DETAILED DESCRIPTION OF THE INVENTION

Figures 1, 2:
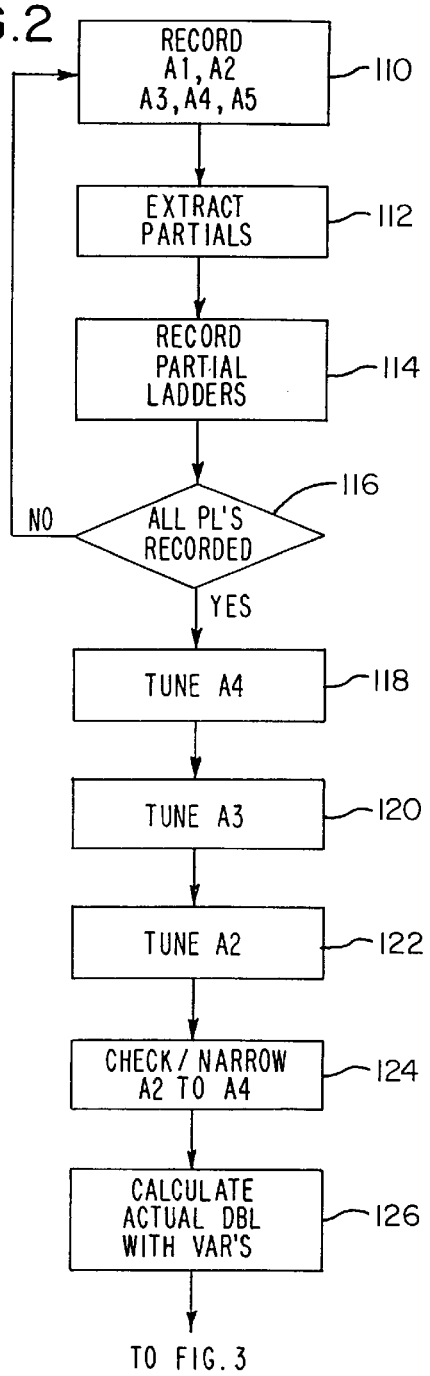
FIG. 1 is a listing of the partial ladders for notes measured in an illustrative embodiment of the present invention.
FIGS. 2–4 are flow charts for operation of the illustrative embodiment represented in FIG. 1.
Figure 3:
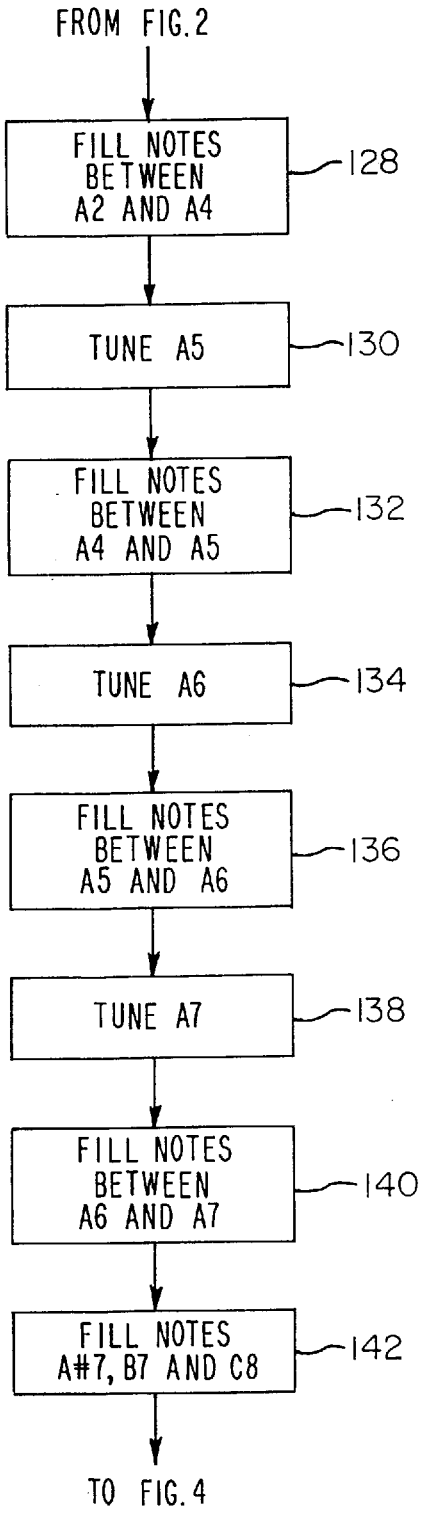
Figure 4:
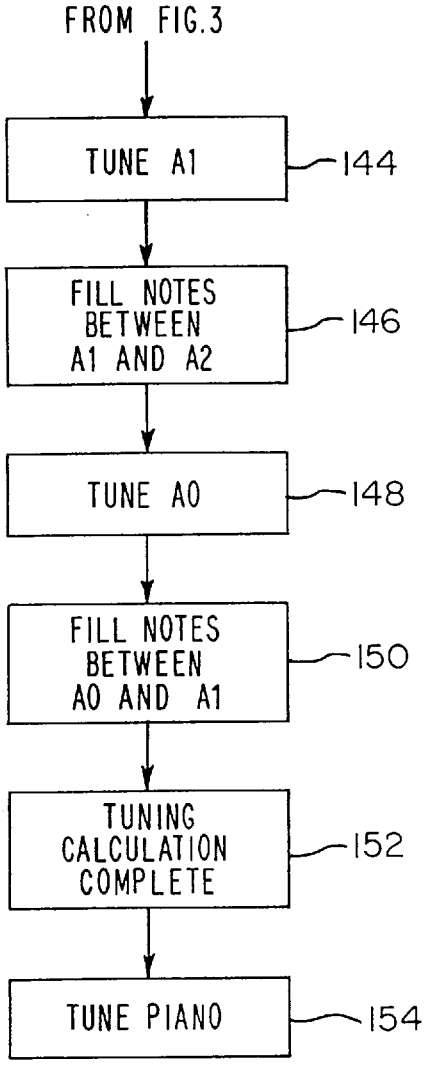

The aural instrument tuning of the present application will now be described with reference to the drawings wherein FIG. 1 is a listing of the partial ladders which are recorded for one embodiment of the present invention. A large variety of embodiments of the aural tuning method are possible, many of which will be described herein and others will be apparent to those skilled in the art from a review of this description. While the present invention is generally applicable to a variety of musical instruments including, for example, harpsichords, organs and pianos, it will be described herein with reference to tuning pianos for which it is particularly applicable and initially being applied.

In the description, the following conventions are followed. The following shorthand is used to represent partials of the piano notes described: piano note name->partial number, i.e., A4->2nd represents the second partial of the note A4. For ease of calculation and familiarity to piano tuners, partial ladders are converted to cents deviation from the standard frequencies of the musical notes they represent. Some calculations are represented in a modified form of the C programming language. The calculations described using this "pseudo-code" will be readily apparent to persons familiar with programming in C and also to those who have never programmed in C. However, it is believed that this form of description is best in enabling those skilled in the art to practice the invention. It is noted that the terms calculate, calculation and the like are intended to cover any form of determination whether by calculation performed in realtime, by pre-calculation and storage in a look-up table or by other appropriate techniques for determining the values referred to herein.

A brief overview of the operation of the present invention will now be provided to facilitate a better understanding of the invention from the detailed description which follows. In the present invention, partial ladders are recorded digitally for at least three notes of a piano which is being tuned. The partial ladders can be complete partial ladders including all partials of each note which is sounded. Preferably, however, the partial ladders include less than all the partials but do include all the significant partials which are necessary to tune the piano. In a working embodiment of the present invention, partial ladders including four partials each are recorded for five notes on the piano as shown in FIG. 1; however, any number of notes can be selected from three up to all the notes of the piano. Each partial ladder is obtained directly as one unit using digital filtering to filter the recorded notes at the appropriate partial frequencies.

Thus, each partial ladder is obtained directly from the piano by sounding the notes to be recorded without ever determining an inharmonicity constant (Ic). In this way, both the inharmonicity and para-harmonicity are inherently included in the partial ladders in the same way that an aural tuner includes them as the piano is manually tuned, i.e., by listening to the notes produced by the piano. One of the partial ladders is then standardized by setting one of its partials to a defined frequency for that partial with the ladders then being equalized within each ladder and relative to the other ladders. Tuning frequencies are then determined from the equalized ladders and the tone generators or strings of the instrument are adjusted to conform their musical notes to the tuning frequencies. With this introduction, a detailed description of an embodiment of the invention corresponding to FIG. 1 will now be made.

In this embodiment, five notes, A1, A2, A3, A4, and A5, are sounded on the piano and recorded using digital sampling techniques, see FIG. 2, block 110. The digitally recorded notes are filtered using well known digital filtering techniques to determine and the partial ladders for those notes, see FIG. 1 and block 112. Preferably, the notes are filtered as they are being recorded to conserve time; however, the time for filtering depends upon the operating speed of the recording device. The recording should be performed using an accurate electronic tuning device, preferably one that is accurate to within 0.01 cents. In the working embodiment of the present invention being described relative to FIGS. 1 and 2, the entire tuning method is performed using an Apple Macintosh PowerBook Duo model No. 2300C. In this way, the exact frequency of each of the partials is recorded as the note is recorded and accurately extracted using a digital bandpass filter as will be described, see block 114. The partial ladders are converted to cents deviation from the standard frequencies of the musical notes they represent for ease of calculation.

Preferably, the recording and filtering of each note is performed at least two times, three times for the working embodiment being described, with the resulting partial ladders being averaged to arrive at the partial ladders which are recorded. The averaging operation increases the accuracy of the recorded partial ladders by reducing possible loss of resolution due to room noise interference and averages the effects of changes in inharmonicity and para-harmonicity due to the user playing the piano at different volumes and sustain lengths.

Once all partial ladders for the notes to be sounded on the piano have been determined and recorded, see block 116, the partial ladders must be equalized. For sake of clarity, a determination of a representative tuning for a Steinway model D 9, grand piano will be described. This illustrative tuning begins from the partial ladder for the note A4 with a typical partial ladder as originally recorded for the note A4 of a Steinway model D 9, grand piano being:

original partial ladder for A4

*A4->4th=+8.24¢*

*A4->3rd=+5.07¢*

*A4->2nd=−0.15¢*

*A4->1st=−1.16¢*<-- must be converted to zero. (A440 hertz)

The cents offset of the primary partial, the lowest partial in the case of the recorded A4 ladder, is subtracted from each of the partials to result in an equalized A4 partial ladder, see 118. The subtraction of the cents offset is necessary since the piano will most likely be out of tune when it is recorded. The primary partial may be the fundamental, as in the A4 ladder, or the lowest partial that is strong enough to be used for tuning if a partial ladder for a note other than A4 is used as the beginning partial ladder. The primary partial is now represented by zero, and each of the other partials is represented by a number that is its cents deviation from the standard frequency of the corresponding partial of the musical note represented by the ladder.

| | original | | | A440 equalized ladder | |
|---|---|---|---|---|---|
| A4—>4th = | +8.24¢ − | (−1.16¢) | = | +9.40¢ | |
| A4—>3rd = | +5.07¢ − | (−1.16¢) | = | +6.23¢ | |
| A4—>2nd = | −0.15¢ − | (−1.16¢) | = | +1.01¢ | |
| A4—>1st = | −1.16¢ − | (−1.16¢) | = | 0.00¢ | <——440 hertz |

The equalized partial ladder for A4 thus tunes A4 and the equalized partial ladder for A4 is then used without modification since the primary partial is A4 itself, which will be normally tuned to 440 hertz, zero cents deviation. The remaining partial ladders are then equalized to tune their corresponding notes. To equalize the ladders/tune the other recorded notes, next an octave is tuned; however, different tuners have varying tastes as to how "wide" to tune the octaves on a piano. Therefore, before calculations to tune or equalize the remaining partial ladders are performed, the user decides how much to "stretch" or widen the octaves. Three octave width variables are specified to define the stretch:

T: how much to widen the A4 to A3 octave, and the treble;

B: how much to widen the A3 to A2 octave, and the bass; and

Dmax: the maximum double octave width for A2 to A4.

For purposes of describing the present invention with respect to T and B, the bass/treble break is between G#3 and A3, i.e., all notes below and including G#3 are considered bass and all notes above and including A3 are considered treble. Typical values for T and B are between 0.0 and 1.2 cents. Although values of up to 4.0 cents have been used by some tuners. Typical values for Dmax are 1.5 to 6.0 cents, with 12.0 cents being the maximum acceptable as shown from empirical testing.

The second note tuned is A3, see 120. Aural tuners will normally match the fourth partial of A3 with the second partial of A4, tuning a "4:2 octave". The present invention performs this function by calculating a cents offset and subtracting the offset from the whole A3 partial ladder. Initially, a new value is determined for the fourth partial of A3 by setting it equal to the second partial of A4 less T. That is:

new_*A*3->4*th*=A4->2*nd*−*T*

For example, selecting a value for T of 0.66 cents, a commonly used value, the calculation for the example piano is:

new_*A*3->4*th*=+1.01¢−(0.66¢)=+0.35¢ resulting in new_A3->4th being equal to +0.3 cents.

Original partial ladder for A3:

*A*3->4*th*=+0.11¢

*A*3->3*rd*=+0.60¢

*A*3->2*nd*=−2.77¢

*A*3->1*st*=−3.24¢

All partials of the original partial ladder for A3, except for the 4th partial, have the original A3->4th value subtracted and the new_A3->4th added to equalize the ladder:

*A*3->*nth*=*A*3->*nth*−*A*3->4*th*+new_*A*3->4*th* where n is equal to the integer values except for four. The resulting A3 equalized partial ladder is:

*A*3->4*th*=+1.01¢−0.66¢=+0.35¢<-- tuned partial

*A*3->3*rd*=+0.60−(+0.11¢)+(+0.65¢)=+0.84¢

*A*3->2*nd*=−2.77¢−(+0.11¢)+(+0.65¢)=−2.53¢

*A*3->1*st*=−3.24¢−(+0.11¢)+(+0.65¢)=−3.00¢

Notice that the 4th partial of A3 is now the same as the 2nd partial of A4, expanded, i.e., flattened, by the amount T (0.66 cents) as specified by the user +1.01¢−0.66¢=0.35¢.

The third note tuned is A2, see block 122. Aural tuners will normally match the sixth partial of A2 with the third partial of A3, tuning what is called a "6:3 octave". The present invention performs this function by calculating a cents offset and subtracting the offset from the whole A2 partial ladder. Initially, a new value is determined for the sixth partial of A2 by setting it equal to the third partial of A3 less B. That is:

new_*A*2->6*th*=*A*3->3*rd*−*B*

For example, selecting a value for B of 1.00 cents, a commonly used value, the calculation for the example piano is:

new_*A*2->6*th*=−0.84¢−1.00¢=−0.16¢ resulting in new_A2->6th being equal to 0.14 cents.

Original partial ladder for A2:

*A*2->6*th*=−1.05¢

*A*2->4*th*=−4.74¢

*A*2->3*rd*=−3.07¢

*A*2->2*nd*=−5.26¢

All partials of the A2 partial ladder, except for the sixth partial, will have the original A2->6th value subtracted and the new_A2->6th added to equalize the ladder:

*A*2->*nth*=*A*2->*nth*−*A*2->6*th*+new_*A*2->6*th* where n is equal to the integer values except for six. The resulting A2 equalized partial ladder is:

*A*2->6*th*=−0.16¢<-- tuned partial

*A*2->4*th*=−4.74¢−(−1.05¢)+−(0.16¢)=−3.85¢

*A*2->3*rd*=−3.07¢−(−1.05¢)−(0.16¢)=−2.18¢

*A*2->2*nd*=−5.26¢−(−1.05¢)+0.14¢=−4.07¢

Notice that the 6th partial of A2 is now the same as the 3rd partial of A3, expanded, i.e., flattened, by the amount B (1.00 cents) as specified by the user.

The invention of the present application next checks the double octave A2 to A4 to make sure it is not wider than the variable Dmax, the maximum double octave width for A2 to A4, see block 124. If this double octave width is narrower than Dmax, then tuning A4, A3 and A2 is finished. A typical value for Dmax is 4.0 cents. The double octave width =A2->4th * (−1.0). If the double octave width is wider than Dmax, then a proportional amount of the excess stretch above Dmax is added to both the A2 and A3 partial ladders. In this way, the two single octaves, A2 to A3 and A3 to A4, are narrowed by an equal amount in hertz which is just enough to bring the double octave, A2 to A4, to the maximum double octave width for A2 to A4 which is the value selected for Dmax.

In the illustrative tuning example, the double octave width is selected as 3.85 cents, which is less than the maximum 4.00 cents. No further calculations are needed for A2, A3 and A4. If the double octave width were greater than Dmax, then double width compensation or narrowing is performed by performing the following steps. First, the overstretch cents are calculated using the equation:

Double octave overstretch=Double octave width−*D*max.

Second, the calculated double octave overstretch is added to each partial in the A2 partial ladder. Third, ⅓ (or 4/10) of the double octave overstretch is added to each partial in the A3 partial ladder. The invention of the present application then calculates the actual octave width variables, see block 126, for later use as will be described:

*T*_ACTUAL=*A*4->2*nd*−*A*3->4*th*

*B*_ACTUAL=*A*3->3*rd*−*A*2->6*th*

*D*_ACTUAL=*A*2->4*th*

If all the notes between A2 and A4 had been sounded, recorded and filtered to record partial ladders for those notes, each note could be tuned in turn as an aural tuner would, using the virtual equivalents of aural tuning as described above. In this case, the described illustrative embodiment wherein only five notes are recorded, the invention fits a curve to the three notes already tuned. The 4th partial will be the listening partial for this part of the tuning, although the 3rd partial would be a logical choice also.

The following calculations are listed in pseudo-code to describe the technique of filling in the missing notes between A2 and A4 in the present invention, see block 128. The tuning settings for the notes of the piano being tuned are stored in an array TUNE_CENTS[x]. The octave width of notes A3 to A4 at the 4th partial, OW34, is calculated using the equation:

$$OW34=A4\text{->}4th-A3\text{->}4th$$

The octave width of notes A2 to A3 at the 4th partial, OW23, is calculated using the equation:

$$OW23=A3\text{->}4th-A2\text{->}4th$$

The temperament curve constant, TC, is calculated using the equation:

$$TC=OW34/OW23$$

Curve constants, KX[N], for the two octave temperament A2 to A4 are then calculated by first calculating a note multiplier, NOTE_MULT which is then used to calculate the curve constants by using the following equations wherein POW is the power function:

$$\text{NOTE_MULT}=POW(TC,\ 1/12)=TC^{1/12}$$

The curve constants, KX[N], are then calculated FOR N=1 TO 11 using the equation:

$$KX[N]=(POW(\text{NOTE_}MULT,N)-1.0)/(TC-1.0)$$

NEXT, notes 49, 37 and 25 are set equal to partials within previously tuned notes A2, A3 and A4 using the following. While it will be apparent to those familiar with tuning pianos, the notes of a piano are consecutively numbered from A0, note 1, to C8, note 88. Thus, note 49 is A4, note 37 is A3 and note 25 is A2:

$$\text{TUNE_CENTS}[49]=A4\text{->}2nd$$

$$\text{TUNE_CENTS}[37]=A3\text{->}4th$$

$$\text{TUNE_CENTS}[25]=A2\text{->}4th$$

The notes 38–48 are then filled in using the equations:

```
FOR N = 1 TO 11
TUNE_CENTS[N + 37] = A3—>4th + OW34*KX[N]
NEXT
FOR N = 1 TO 11
TUNE_CENTS[N + 25] = A2—>4th + OW23*KX[N]
NEXT
```

Settings for note numbers 25 through 49 are now in the array TUNE_CENTS[x].

The invention of the present application next moves up the piano to calculate the next octave above A4 (note 49). First it tunes A5, see block 130, by determining the setting for A5 (note 61) the same way an aural tuner might, using a compromise between the 4:2 and 2:1 single octaves, and the 4:1 double octave.

The intervals used are:

$$\text{FOUR_TWO}=A4\text{->}4th$$

$$\text{TWO_ONE}=A4\text{->}2nd$$

$$\text{DOUBLE_OCT}=A3\text{->}4th$$

In this portion of the piano, around A5, aural tuners normally will tune the single octaves so that the 4th partial of the lower note matches the 2nd partial of the upper note, i.e., a 4:2 octave. They will also check the single octave 2:1, i.e., the 2nd partial of the lower note with the 1st partial on the upper note, matching to make sure it is not too wide, and check the double octave to make sure it is only slightly wide. The formula the invention of the present application uses the following equation to do the equivalent calculation of the 2nd partial of A5:

$$\text{new_}A5\text{->}2nd=(\text{FOUR_TWO}+(\text{TWO_ONE}+T\text{_ACTUAL})+(\text{DOUBLE_}OCT+0.3))/3$$

Thus, the average of the three aural indicators for A5 is used. The A5 partial ladder is offset by subtracting the original A5->2nd value from all partials of the A5 partial ladder and equalized by then adding the new_A5->2nd to all partials:

$$A5\text{->}nth=A5\text{->}nth-A5\text{->}2nd+\text{new_}A5\text{->}2nd$$

where n is equal to the integer values except for two. Next, the notes between A4 and A5 are filled, see block 132, in using the equations:

```
NOTE_MULT = POW(2.0, 1/12) = 2^(1/12)
FOR N = 1 TO 11
K[N] = POW(NOTE_MULT,N) - 1.0
NEXT
OW54 = A5—>2nd - A4—>2nd
```

where OW54 is the octave width of notes A4 to A5 at the 2nd partial,

```
FOR N = 1 TO 11
TUNE_CENTS[N + 49] = A4—>2nd + OW54*K[N]
NEXT
TUNE_CENTS[61] = A5—>1st
```

Settings for note numbers 25 through 61 are now in the array TUNE_CENTS[x].

While it is preferred to measure A6 directly and extract its partial ladder as described above relative to notes Al through A5, the partial ladders of A6 and notes above A6 are difficult to measure above the 2nd partial on most pianos, and even the 2nd partial of A6 is often difficult to measure accurately. Thus, while direct measurement is the preferred method, calculation as will be described can and often must be used to tune A6, see block 134. In the illustrated embodiment of the invention of the present application, calculation is used to determine the next octave above A5 (note 61).

The setting for A6 (note 73) is calculated in the same way an aural tuner might tune, using a compromise between the 2:1 single octave, i.e., the 2nd partial of the lower note with the 1st partial on the upper note, matching to make sure it is not too wide and the 4:1 double octave, i.e., the 4th partial of the second lower note with the 1st partial on the upper note, matching to make sure it is not too wide. The intervals used are:

TWO_ONE=A5->2nd

DOUBLE_OCT=A4->4th

In this portion of the piano, around A6, aural tuners normally will tune the single octaves so that the 2nd partial of the lower note matches the 1st partial of the upper note, i.e., 2:1 octave. They will also check the double octave to make sure it is only slightly wide. An equivalent calculation is performed by the invention of the present application using the following formula to calculate the 1st partial of A6:

new_A6->1st=(TWO_ONE+T_ACTUAL+DOUBLE_OCT)/2

Thus, the average of the two aural indicators for A6 are used. If the A6 partial ladder was recorded, it is offset and equalized. That is, all partials of the A6 partial ladder will have the original A6->1st value subtracted and the new_ A6->1st is
added to all partials but the first partial to equalize the ladder:

A6->nth=A6->nth−A6->1st+new_A6->1st where n is equal to the integer values except for one.
If the A6 partial ladder is not, or can not be recorded off the piano, it can be calculated using the following equations:

A6->2nd=(A5->2nd-A5->1st)*3.0

A6->lst=(TWO_ONE+T_ACTUAL +DOUBLE_OCT)/2

The notes between A5 and A6 are next filled in, see block 136, using the equations:

OW65=A6->1st−A5->1st where OW65 is the octave width of notes A5 to A6 at the 1st partial,

```
FOR N = 1 TO 11
TUNE_CENTS[N + 61] = A5—>1st + OW65*K[N]
NEXT
TUNE_CENTS[73] = A6—>1st
```

Settings for note numbers 25 through 73 are now in the array TUNE_CENTS[x].

For the final treble octave, A6 to A7, the note A7 is tuned, see block 138. In the illustrated embodiment of the present invention, the note A7 is tuned using the single, double, and triple octave, if available:

SINGLE_OCT=A6->2nd

DOUBLE_OCT=A5->4th

If the 8th partial of A4 is measured, then the following operations are preformed:

DOUBLE_PLUS=A4->8th where DOUBLE_PLUS is the actual triple octave. If no 8th partial is recorded for A4, an alternative extra stretch target is calculated:

DOUBLE_PLUS=DOUBLE_OCT+(DOUBLE_OCT−SINGLE_OCT)

The human tuner specifies to which of these A7 is to be tuned, or the user can specify tuning a weighted average of two of the types of octaves. For instance, if the user wants to tune half way between the single and double octave, then the user specifies "1.5", and invention averages the single and double octave:

A7->1st=(SINGLE_OCT+DOUBLE_OCT)/2

If the user specifies "2.0", then A7 is tuned to the double octave:

A7->1st=DOUBLE_OCT

If the user specifies "2.5", then A7 is tuned to an expanded double octave:

A7->1st=(DOUBLE_OCT+DOUBLE_PLUS)/2

OW67=A7->1st−A6->1st where OW67 is the octave width of notes A6 to A7 at the 1st partial. The high treble HT constant is set at 3.0 for filling in the notes between A6 and A7, see block 140.

HT=3.0

The basis for the high treble curve is the 12th root of 3.

```
NOTE_MULT = POW(HT, 1/12)
FOR N = 1 TO 11
KT[N] = (POW(NOTE_MULT,N) − 1.0)/(HT − 1.0)
NEXT
FOR N = 1 TO 11
TUNE_CENTS[N + 73] = A6—>1st + OW*KT[N]
NEXT
TUNE_CENTS[85] = A7—>1st
```

Settings for note numbers 25 through 85 are now in the array TUNE_CENTS[x].

The last three notes, A#7, B7 and C8 (notes 86, 87, 88) are tuned to a continuation of the above curve, see block 142. These notes are among the least critical on the piano since human ears are the least sensitive at their frequencies.
Settings for note numbers 25 through 88 are now in the array TUNE_CENTS[x].

Since the treble has now tuned from A2 up to C8 we need to calculate the notes down to A0. The next note to tune is A1, see block 144.
Intervals for tuning A1:

THREE_SIX=A2->3rd

EIGHT_FOUR=A2->4th−(A1->8th−A1->6th)

tuned as A1's sixth partial.

DOUBLE_OCT=A3->1st+(A1->6th−A1->4th)

tuned at A1's sixth partial.
Next tune a compromise between these three intervals:

```
A1—>6th = (THREE_SIXTH-B_ACTUAL*3 +
EIGHT_FOUR + DOUBLE_OCT −D_ACTUAL)/3
TUNE_CENTS[13] = A1—>6th
OW12 = A2—>6th − A1—>6th
```

where OW12 is the octave width of notes A1 to A2 at the 6th partial. The notes between A1 and A2 are next filled in, see block 146, using the equations:

```
FOR N = 1 TO 11
TUNE_CENTS[N + 13] = TUNE_CENTS[13] + OW12*N/12
NEXT
TUNE_CENTS[13] = A1—>6th
```

Settings for note numbers 13 through 88 are now in the array TUNE_CENTS[x].

Notice that between A1 and A2, the "curve" is actually a straight line. This method has been found empirically to be the most accurate.

Finally the note A0 is tuned, see block 148, and the notes from A1 down to A0 are filled in, see block 150. The following intervals are used:

```
EIGHT_FOUR = A1—>4th
the 8:4 single octave
DOUBLE_8_2 = A2—>2nd
the 8:2 double octave
TRIPLE_OCT = A3—>1st
the 8:1 triple octave
A0—>8th = (EIGHT_FOUR-B_ACTUAL +
DOUBLE_8_2-D_ACTUAL + TRIPLE_OCT-D_ACTUAL)/3
TUNE_CENTS[1] = A0—>8th
```

The above assignments give each of the single, double and triple octaves equal weight in determining A0.

The notes from A0 to A1 are then filled in using the equations:

```
OW1 = A0—>8th - A1—>8th
B = POW(OW12/OW23, 2)
NOTE_MULT = POW(B, 1/12)
FOR N = 1 TO 11
KB[N] = (POW(NOTE_MULT, N) - 1)/(B - 1)
NEXT
FOR N = 11 TO 1
TUNE_CENTS[n + 1] = A1—>8th + OW12*KB[12 - N]
NEXT
```

Settings or target frequencies for note numbers 1 through 88 are now in the array TUNE_CENTS[x] for the piano, see box 152. After the complete tuning is available, it is used to tune the piano by sounding the notes of the piano and comparing them to the target frequencies, see block 154. The tuning process is preferably performed using a unique display which provides highly accurate macro and micro tuning information in a single display.

Figure 5:
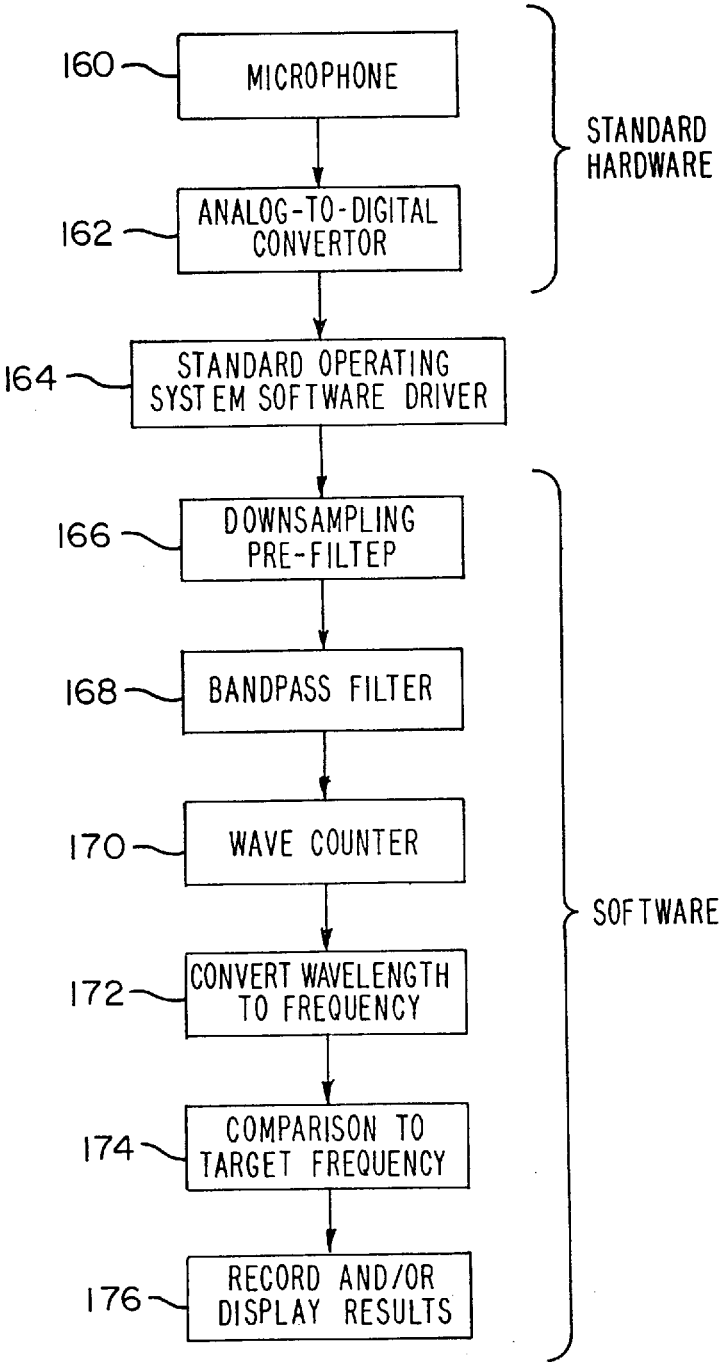
FIG. 5 is a flow chart illustrating sampling, recording and filtering aspects of the present invention.

To ensure an understanding of the operation of the aural tuning of the present application, the sampling, recording and filtering of blocks 110–116 of FIG. 2 will now be described with reference to FIG. 5. As a note is sounded on a piano being tuned, it is received by a microphone 160 for generating an analog signal which is passed to an analog-to-digital (A/D) converter 162. The digital output of the A/D converter 162 is passed to a software driver 164 of a computer system. The implementation of the illustrative embodiment of the invention as described above is implemented entirely in an Apple Macintosh PowerBook Duo model No. 2300C which is preferred for operation of the present invention. Of course, the aural tuning of the present application could also be embodied entirely in hardware or on PC's operating under DOS or one of the Windows operating systems. Implementations for such PC's are currently being developed.

The sampled sound data received from via the microphone 160, the A/D converter 162 and the software driver 164 are recorded and pre-filtered by integer downsampling the data, see block 166, to reduce the amount of data which also reduces the computation time for the next stage of filtering, a bandpass filter, see block 168. The reduced number of data points also increases the rejection of the stopband frequencies of the bandpass filter.

The Nyquist theorem states that the sample rate must be at least twice the highest frequency desired. The Nyquist Frequency is ½ the sample frequency. When downsampling, the effective sample frequency is changed by dividing the original sample frequency by the integer downsample rate. Care must be taken not to approach the Nyquist frequency too closely. Empirical evidence shows that any frequency greater than ⅓ the Nyquist frequency will mean some loss of accuracy in determining the exact wavelength and using an effective sample frequency greater than ½ the Nyquist frequency will result in some loss of wave resolution.

Integer downsampling is done to the maximum degree possible without lowering the effective sample frequency below six times the desired target frequency. In the illustrated embodiment of the present invention, 22,050 samples per second are taken, each sample being 8 bits. Using the more standard 44,100 samples per second with 16 bit samples also will work; however, such higher sampling requires more computation time with little or no increase in wave resolution.

A finite impulse response (FIR) filter is used for the bandpass filter of the block 168 which is implemented by discrete convolution. The infinite length impulse response of an ideal frequency filter is truncated by multiplying I by a time-domain Kaiser-Bessel window. The passband is determined by setting the low and high frequency cutoffs which, in a software implemented filter can be readily changed as the filter is used in a tuning operation, for example the filter passband could be changed for each if desired. The passband used for the bandpass filter in the illustrated embodiment of the invention preferably ranges from about 50 cents to 200 cents wide. For a 50 cents wide passband:

Target frequency: ft

Frequency of lower "corner" of passband: fl

Frequency of higher "corner" of passband: fh $$fl = ft/\sqrt[48]{2}$$

$$fh = ft(\sqrt[48]{2})$$

For a passband that is 200 cents wide, the twelfth root of two ($\sqrt[12]{2}$) is substituted as a multiplier or divisor in the above equations. It may be preferred to set the passband to frequencies between about 50 cents and 200 cents for software implementations particularly for bass notes although a fixed passband is perfectly acceptable for hardware implementations.

While a passband wider than about 200 cents can be used for the treble frequencies, using a passband wider than 200 cents does not work well for tuning the bass notes in the piano, since for example, the seventh and eighth partials are only about 231 cents apart. This is too close to the corner frequencies of the filter such that interference will result if the passband is wider than 200 cents. The higher partials are even closer together (in cents) than the 7th and 8th partials.

It is common filter design practice that the duration of a filter's impulse response (M) should be no greater than one-tenth of the sample-frame that is to be filtered, i.e., the duration of the data being processed. However, to achieve the wavelength measurement accuracy needed for the instrument tuning of the present application, four-tenths of the duration has been found to produce the best results.

Sample frame sizes that are practical are dependent on the capabilities of the hardware. The recording hardware of the illustrated embodiment of the present application, an Apple Macintosh PowerBook Duo model No. 2300C, is capable of supplying data 512 samples at a time. Sample-frames must therefore be a multiple of 512 on this hardware. Useful sample frame sizes range from 1 kilobyte, 1024 samples, (about 1/20th of a second) at C8, up to 6 kilobytes, 6144 samples, at A1 (about 0.3 seconds). Longer sample frames are needed for the lower frequencies since they will supply more waveforms per sample frame, increasing accuracy. Shorter sample frames work well with the very high frequencies, not only because more waveforms are present in the same time period, but because the very high notes on a piano often do not last long enough to use a long (6k) sample-frame.

The Kaiser-Bessel impulse response window w[n] of length N=M+1 is calculated using the equation:

$$w[n] = I_0[b(1-[(n-a)/a]^2)^{1/2}]/I_0(b) \qquad 0 \leqq n \leqq M$$
$$w[n] = 0.0, \qquad \text{otherwise}$$

where $I_0$ is the zeroth-order modified Bessel function of the first kind, a=M/2 and b is a shaping parameter. Since the Kaiser-Bessel bandpass filter is a symmetric (even) function, this symmetry is exploited to reduce by a factor of 2, the number of multiplications required to implement the filter.

The stopband attenuation of the Kaiser-Bessel bandpass filter is controlled by varying the shaping parameter, b. Increasing b increases the stopband attenuation. Kaiser determined that the stopband attenuation, A, in decibels was empirically related to b:

$$b=0.1102(A-8.7)$$

if $A>50$

For the instrument tuning of the present application, the Kaiser-Bessel bandpass filter uses values for A of at least 60 decibels, as calculated by the formula:

$$A=60+(d-1)1.5$$

where d is the integer downsample factor.

To implement the filter using the impulse response window w[n], discrete convolution is used. The results of the bandpass filter are measured for wavelength as follows: The first occurrence of a data point positive-to-negative zero crossing is the start of a waveform measurement. To maximize accuracy, it is important to measure the maximum number of waveforms possible within the sample frame, although some wasted data at the start and end of the sample frame is unavoidable.

The end of the wave measurement occurs at the last positive-to-negative zero crossing. The average wavelength of the sample frame is then computed by first compute the samples per waveform ws:

$$ws=t/wc$$

where t is the time in samples from the start of the first waveform to the end of the last waveform and wc is the waveform count or number of waveforms counted in the sample frame within the time t, see block 170.

Next the frequency of the waveforms f is computed using the equation:

$$f=sf/d/ws$$

where sf is the sample frequency in hertz and d is the integer downsample factor, see block 172.

In the illustrated embodiment of the invention, between 2 and 6 seconds of data is recorded, 6 seconds on the lower notes and 2 seconds on the higher. The sample data is then filtered an additional time for each partial that is needed in the partial ladder, four times in the illustrated embodiment. With the hardware used to implement the illustrative embodiment, one partial is filtered realtime, i.e., while the next sample frame is being recorded, so only the remaining partials need to be filtered after later. Faster computers would allow filtering of all the partials realtime. The frequencies determined are then digitally compared to the target frequencies which were determined in the tuning calculation as described above and recorded or the result is displayed for tuning the corresponding piano, see blocks 174, 176, respectively.

As described above, three partial ladders are recorded for each recorded note by having the user play the same note three times with the three partial ladders being averaged to generate the partial ladder which is recorded. The result for each note recorded and filtered in this way is a partial ladder that describes that note on the piano to an extremely high degree of accuracy. The partial ladder can then be used to calculate a virtual tuning, run a realtime display relative to one or more of the partials, or display the partial ladder directly. While the foregoing is in accordance with standard digital filtering techniques which are well known in the art, those desiring additional information should consult: Oppenheim, A. V. And R. W. Schafer, *Digital Signal Processing*, Englewood Cliffs, N.J., Prentice Hall, Inc., 1975; and, Oppenheim, A. V. And R. W. Schafer, *Discrete Time Processing*, Englewood Cliffs, N.J., Prentice Hall, Inc., 1989 which are incorporated herein by reference.

Many alternate embodiments of aural tuning in accordance with the present invention are possible. Different notes or notes in addition to A1–A5 can be recorded. For example, the partial ladders for A1–A6 can be recorded, the partial ladders for A2–A4 could be recorded, the partial ladders for a majority of the notes or all of the notes could be recorded, etc. In addition to these alternates, the partial ladders for the notes at the bass/midrange break or transition area of the piano can also be recorded.

The bass/midrange break or transition area of the piano is the area where the wound bass strings transition into plain wire strings, and where the strings change from being overstrung to the bass bridge to understrung to the treble bridge. This transition area is typically between the notes F2 and F3 and can include as few as two notes, if the bridge transition coincides with the string type transition, or as many as 12 notes, if there are wound strings on the treble bridge. All notes from the highest note on the bass bridge to the first plain wire note on the treble bridge should have their partial ladders recorded.

The transition area in the piano is where piano scale designers have the greatest difficulty in making the partial ladders change with a smooth progression. If the progression is not smooth, then the partial ladders of the notes at the transition will need more equalization based on comparing aural tuning intervals which can best be accomplished by recording the transition area notes.

Two additional aspects of the present invention will now be described: automatic note switching and automatic pitch raising. With regard to automatic note switching, previous electronic tuning devices require the user to operate a physical switching mechanism of some kind to tell the tuning devices to advance to the next note. Operation of the switching mechanism requires extra time for the user and tends to distract the user from the tuning task at hand. Also, since the switching mechanism is operated 88 times for each pass through the typical piano, it is heavily used and therefore subject to frequent failure.

Figure 6:
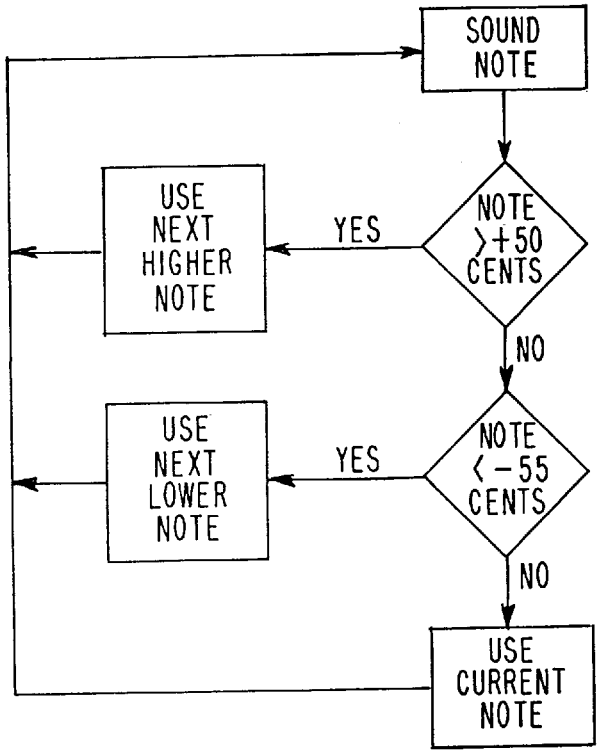
FIG. 6 is a flow chart illustrating an automatic note switching aspect of the present invention.

The manual switch operation problem is solved in the tuning system of the present application by comparing the incoming pitch of each sample frame for the frequency of the next higher and/or next lower note on the musical scale to the current note setting. If the frequency of the input pitch is greater than 50 cents sharp to the current setting, then a note-up switch is performed without operation of a physical switch by the user. If the frequency of the input pitch is less than −55 cents, then a note-down switch is performed without operation of a physical switch by the user, see FIG. 6. To provide hysteresis, −55 cents is used instead of −50 cents for the note-down operation to prevent the tuning system from oscillating between one note and an adjacent note. Such oscillation could occur if the input pitch is exactly 50 cents off from a standard note frequency. The automatic note switching feature requires a bandwidth filter having a passband of at least 200 cents, since the next note up or note down will be about +100 cents and −100 cents respectively.

With regard to the automatic pitch raising feature, piano tuners have wrestled for many years with a problem of tuning pianos that are significantly off from the desired pitch. If the tension is very far from where it will be when the piano is perfectly in tune, flat for instance is typical, then the piano structure will compress as the string tension is increased. This compression, combined with the strings themselves straightening and stretching, causes the piano to go flat as it is being tuned.

To compensate for this fact, piano tuners target a higher pitch than the final desired result. This type of tuning is called in the trade, a "pitch raise" tuning. The amount that the target pitch is higher than the final desired pitch is called the "overpull". While it is far more common for a tuner to find a piano flat, and to pitch raise the piano using a sharp overpull to compensate, some pianos will be sharp, and may need pitch lowering using a flat compensation or "flat overpull", i.e, underpull. The exact same principles apply in both cases. A target pitch which is flat is calculated, and the piano will decompress as it is pitch lowered.

Calculating the amount of overpull for each note is the most difficult aspect of a pitch raise tuning. Some pianos will have a very stiff frame which does not compress much while others are weak and compress greatly. In general terms, the bass needs less overpull, the midrange more overpull and the high treble the most overpull. The bass/midrange break of a piano for pitch raise tuning is the area where the wound bass strings transition into plain wire strings and where the strings change from being overstrung to the bass bridge to understrung to the treble bridge. This change is commonly between the notes F2 and F3.

One currently available tuning machine has a feature whereby the user measures the flatness of the piano note before tuning, the machine is then used to calculate an overpull of 25% and offsets the tuning by that amount. The problem with this tuning machine is that 25% is too much overpull for the bass, almost but not quite enough for the midrange and very inadequate for the treble. The user must then take extra time and recalculate a different percentage manually. Also, taking the measurement itself is a time consuming feature and is commonly only done once per octave further reducing accuracy.

This pitch raising (or lowering) problem is solved in the aural tuning of the present application by a special mode of operation which automatically records, and calculates the overpull with no user involvement at all. A sliding scale of preset overpull percentages which has come from extensive empirical testing is used. A different percentage overpull can be used for each note. A table of percentage overpulls currently used in the present invention is as follows:

| | Note Names | | | | | | | | | | | |
|---|---|---|---|---|---|---|---|---|---|---|---|---|
| Oct# | C | C# | D | D# | E | F | F# | G | G# | A | A# | B |
| 0 | | | | | | | | | 0, | 4, | | 8, |
| 1 | 12, | 12, | 12, | 12, | 12, | 12, | 12, | 12, | 12, | 12, | 12, | 12, |
| 2 | 12, | 12, | 12, | 12, | 12, | 12, | 12, | 12, | 12, | 12, | 12, | 35, |
| 3 | 34, | 33, | 32, | 31, | 30, | 30, | 30, | 30, | 30, | 30, | 30, | 30, |
| 4 | 30, | 30, | 30, | 29, | 29, | 28, | 28, | 28, | 27, | 27, | 27, | 27, |
| 5 | 27, | 27, | 28, | 28, | 29, | 29, | 30, | 30, | 31, | 32, | 33, | 34, |
| 6 | 35, | 36, | 37, | 38, | 38, | 38, | 38, | 38, | 38, | 38, | 38, | 38, |
| 7 | 38, | 38, | 38, | 38, | 37, | 35, | 33, | 31, | 29, | 27, | 25, | 23, |
| 8 | 21 | | | | | | | | | | | |

Figure 7:
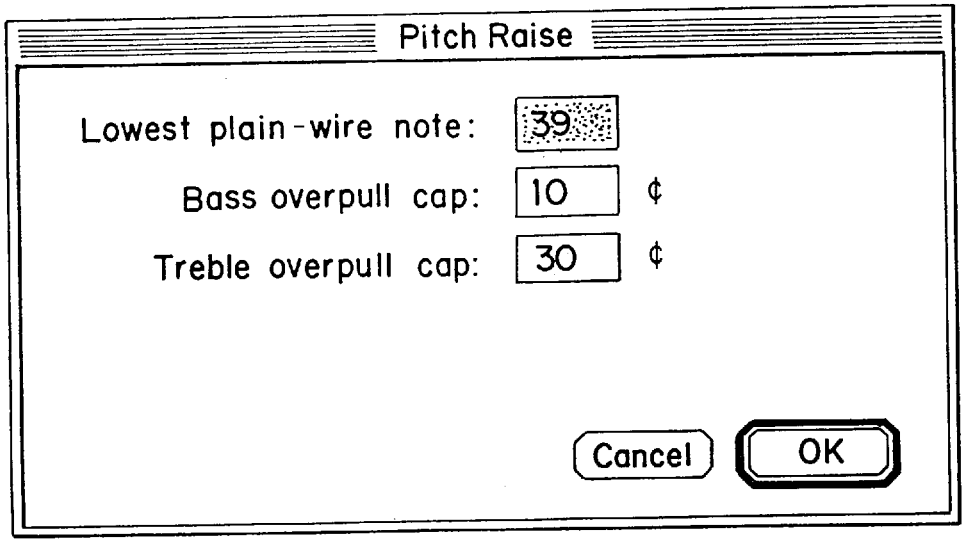
FIG. 7 is a pull-down screen available in a C program which performs the tuning operations of the present invention.

This table presumes the user has indicated that the lowest plain wire note is B2, note number 27. At this point (A#2 to B2) the overpull changes form 12% to 35% since the plain wires need more overpull than the wound wires. The point of this change is made at the designated lowest plain wire note which is set by the user. In addition to the lowest plain wire note, the user can set two other parameters for the pitch raise mode of operation, a bass overpull cap, set in cents, and a treble overpull cap, set in cents, which are input to the computer via the keyboard through a pull-down screen available in a C program which performs the tuning operations of the present invention, see FIG. 7. The overpull caps reduce the possibility of string breakage during pitch raise tuning.

The pitch raise sequence is based on tuning the piano from A0 to C8, tuning all the strings for each note in unison before moving to the next note up. Starting with A0, the original pitch of the note is recorded automatically, and stored for later use. No overpull is used for A0. For each note after A0, starting with A#0, the overpull is a percentage of the average original pitches of a number of the previous notes, such as the previous six notes, or as many notes as are available. Thus, A#0 only would have one note to base the overpull on, B0 will have two, etc. The overpull may also include the note being tuned. In that case, the overpull is a percentage of the average original pitches of the note being tuned and a number of the previous notes, such as the previous six notes. Of course, other numbers of previous notes can be used for this aspect of the present invention and the pitch raise tuning can be tuning the piano from C8 to A0.

Since concert tuning accuracy is not as important as speed in pitch raise operation, only a one second sample is required for the lowest notes on the piano, and only a ¼ second sample is needed in the highest treble notes. This aspect of the tuning system of the present application not only increases accuracy of pitch raise tuning, but it reduces the time and tuner fatigue, since the tuner need not stop and take readings every note, or every few notes.

An alternate to the pitch raise tuning of the tuning system of the present application is having two or more overpull charts such as the one above. For example, one chart can be provided for weak pianos which require more overpull, one chart can be provided for average pianos and one chart can be provided for very stiff pianos which require less overpull.

Figure 8:
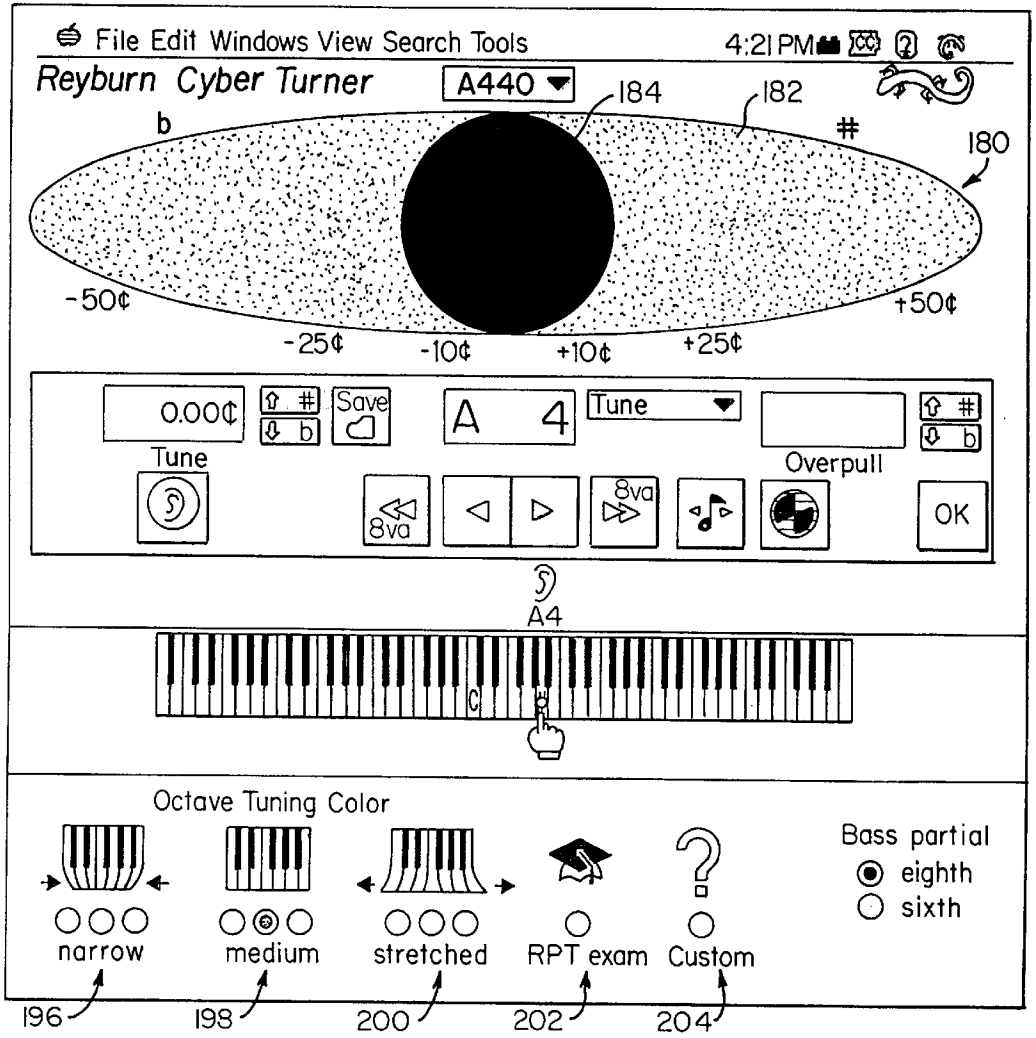
FIG. 8 is a view of the screen of an Apple Macintosh PowerBook Duo model No. 2300C programmed to operate as a tuning system of the present invention.

The present invention is preferably operated using a unique display which comprises another aspect of the tuning system of the present application and provides highly accurate macro and micro tuning information in a single display. A view of the screen of an Apple Macintosh PowerBook Duo model No. 2300C programmed to operate as a tuning system of the present application is shown in FIG. 8 and includes the display 180 upon which a circular pitch marker is displayed as will be shown and described. Since the pitch marker normally rotates or spins when a sounded note is relatively close to the target pitch to which the note is to be tuned, the pitch marker is often referred to herein as a "spinner".

Figure 9:
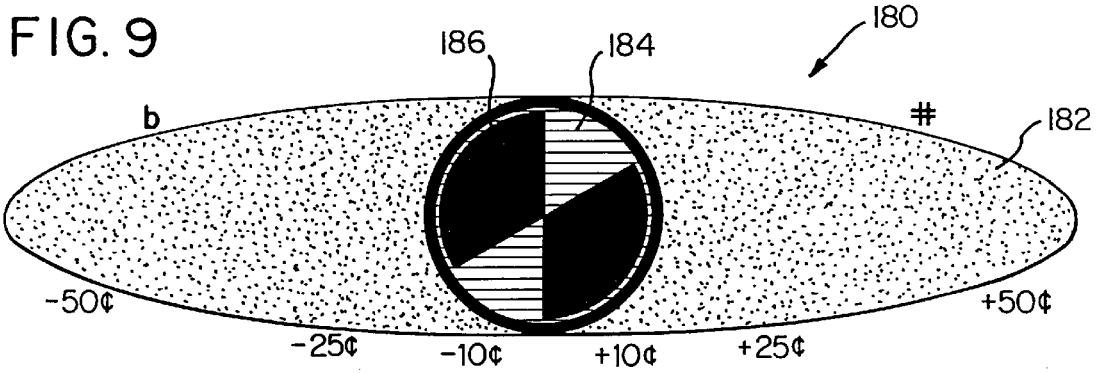
FIGS. 9–12 show a unique display aspect of the present invention for graphically and dynamically displaying macro and micro tuning information in a single display.
Figure 10:
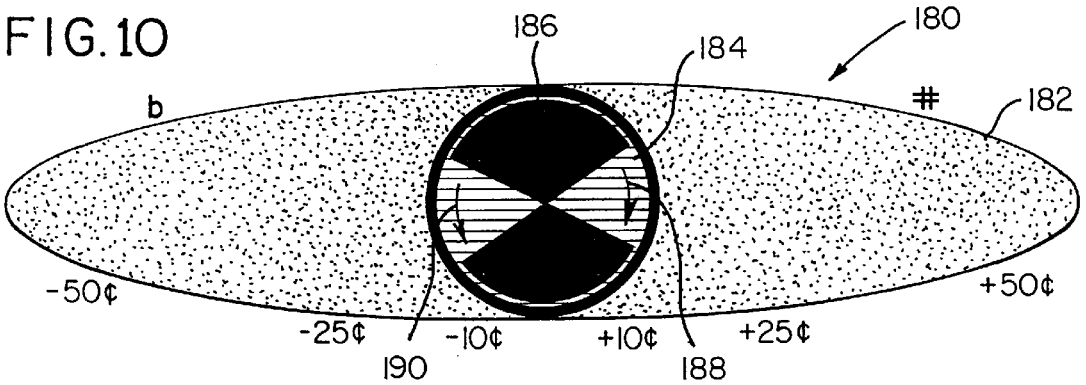

The display 180 is unique for graphically and dynamically showing the relative pitch of an unknown pitch. The large horizontal oval area 182 represents the display working area. When the pitch of the input note is in tune, the "spinner" 184 is positioned over the dark circle 186 positioned generally in the center of the display 180 and the spinner 184 is stationary, see FIG. 9. If the input pitch is within a very small window, which can vary from 0 cents up to any reasonable amount with 4.0 cents being used for the window of the illustrated embodiment of the invention, the spinner 184 will stay centered on the dark circle 186, but rotates or spins slowly clockwise 188 to indicate sharp, and counter-clockwise 190 to indicate flat. The centering of the spinner 184 on the dark circle 186 may be referred to as "pitch lock" and may only occur for a match of an unknown pitch with a tuning frequency which would correspond to a 0 cents window. The farther away the pitch of the sounded note is from the tuning target frequency, either flat or sharp, the faster the spinner 184 spins.

Figure 11:
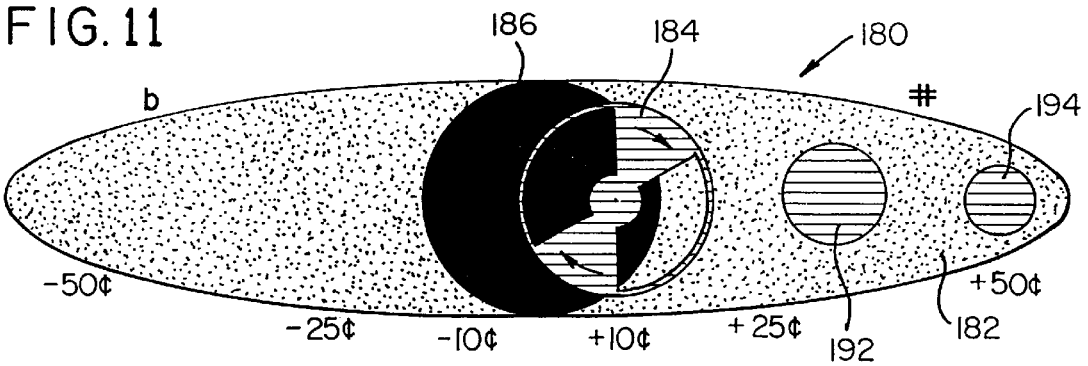
Figure 12:
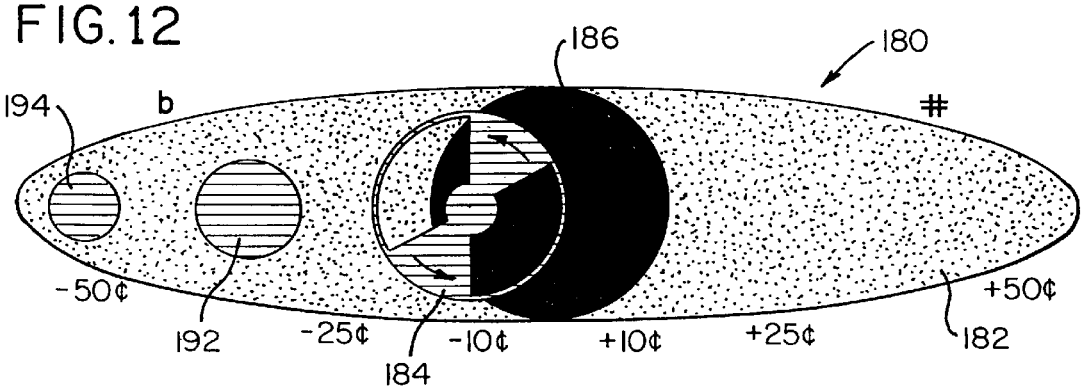

If the pitch of the sounded note is outside the window, for example 2.0 cents away from the tuning target frequency for the illustrated embodiment of the invention, the spinner 184 moves linearly to the right of the display 180 to indicate sharp, and to the left of the display 180 to indicate flat, see FIG. 11 and FIG. 12, respectively. Movement of the display to the right and the left is preferably in proportion to the extent an unknown pitch exceeds the upper and lower boundaries of the small window within which the spinner 184 will stay centered on the dark circle 186. Proportional movement as used herein is intended to include movement in a logarithmic manner or according to some other function controlling the movement. The spinner 184 continues to spin even though its position is changed, i.e., even though the spinner 184 is moved either to the right or to the left.

As the error in pitch approaches 25.0 cents sharp or 25.0 cents flat, the spinner 184 is spinning too fast to determine the direction of spin, and the spinner 184 gradually turns into a completely filled in circle by expanding from the center as shown in FIGS. 11 and 12. Two completely filled circles or pitch markers 192, 194 are shown for different corresponding sharp and flat pitch errors in FIGS. 11 and 12.

When the pitch of a sounded note is more than 25 cents off, only an approximate indication of the pitch is needed by the human tuner. Current computer displays also have an upper limit to the number of frames per second that can be used. The illustrated embodiment of the invention of the present application uses a variable frame rate display with a maximum frames-per-second rate of 30 for active matrix thin film transistor or Dual Scan Liquid Crystal Diode (LCD) displays. Some passive LCD displays are limited to 15 to 20 frames per second.

In the illustrated embodiment, there are 128 discrete positions around the 360 degrees in which the spinner 184 rotates. As the spinner 184 moves to the extreme right or the extreme left of the display 180, it becomes smaller, reinforcing the "out-of-tune" visual feedback for the user. The extreme right and left ends of the oval display represent −55 cents to +55 cents. The whole display represents a 110 cent window. Thus, all of these different display screens or appearances are used by a human tuner to determine whether or not an unknown pitch produced by a musical instrument is "in tune" or not. That is, whether the unknown input pitch is higher or lower in frequency compared to a target or standard frequency, and by how much.

Another aspect of the display 180 relative to its macro-tuning capability is to make the scale non-linear, for example logarithmic. In this way a larger window than 110 cents could be displayed while retaining the same sensitivity close to the center of the display. Such a display could easily encompass a 200 cents window, a 400 cents window or essentially any reasonable size desired by the user. Once the spinner represents more than a selected off pitch amount, such as 25 cents, it no longer needs to spin but can indicate flat or sharp on a coarse logarithmic scale, −50 cents, −100 cents, −200 cents, etc.

It is to be understood that other shapes of displays, other than oval, and other shapes of spinners, other than circular, can be used in the present invention. In essence, any geometric or other shapes which can be combined to form a readable and preferably appealing display can be used for the display and spinner. It is also noted that while the center of the display is used in the illustrated display, "center" as used herein should be understood to mean a position on a display at which the spinner is located for sounded notes which are at or close to a target tuning frequency. In this regard, movement in two directions other than right and left can be used, for example up and down, up and left, up and right, etc. or the spinner can be moved along curves leading in different directions to indicate sharp from flat, for example, the spinner could be moved from the peak of a bell curve along its downwardly sloping sides. All possible variations of the display which embody the basic macro and micro display capabilities as described are considered to be within the scope of the display aspect of the present invention.

Figure 13:
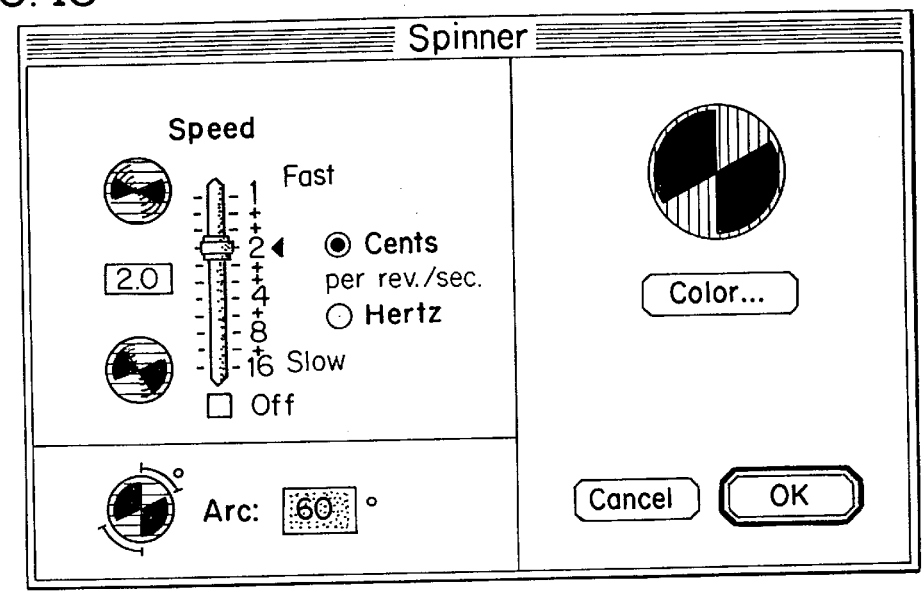
FIG. 13 illustrates a pull-down screen available in a C program which performs the tuning operations of the present invention and permits user setting of various aspects of the unique display shown in FIGS. 9–12.

There are several unique features of the display 180 which make it particularly useful for tuning musical instruments. Initially, the combination of both macro-tuning and micro-tuning indications in a single unified display. The ability to display pitch difference with a dynamic rotational indicator whose speed is proportional to cents. Previous rotational displays have been proportional to hertz; however, with the display of the illustrative embodiment of the invention, the user can select cents or hertz relative spinning, see FIG. 13 which illustrates a pull-down screen available in a C program which performs the tuning operations of the present invention.

The display 180 gives the user the ability to change the relative rotational speed of the spinner 184 or pitch marker. The display 180 can be implemented in dedicated hardware, or as software running in a standard computer as in the illustrated embodiment of the present application. If the "Off" box is checked in FIG. 13, the pitch marker or spinner 184 will be a filled in circle, no matter what the input pitch. The Arc angle of the spinner 184 in degrees can be changed depending on the physical display type. With a passive matrix LCD display, it may be better visually to use the spinner if the arc is increased to 90 degrees. Finally, the color of the spinner 184 can be set to any color which the hardware, whether dedicated hardware or hardware of a computer, is capable of displaying.

Figure 15:
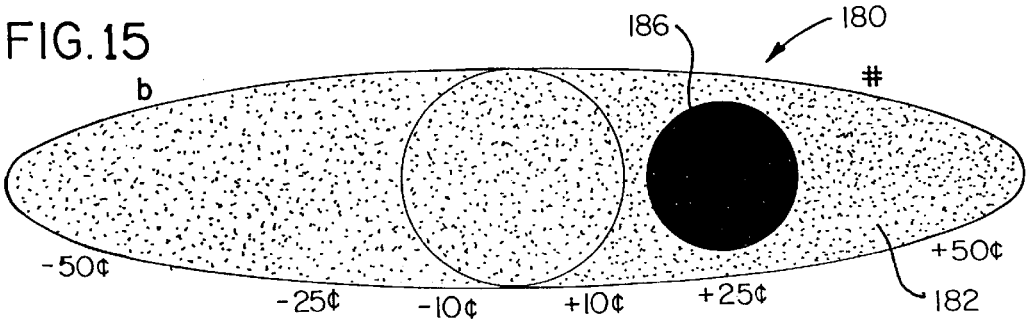
FIG. 15 illustrates a display of the present invention wherein the target has been moved to the right for a sharp overpull pitch raise tuning.

Another aspect of the display relative to pitch raise tuning is that the "target", which is the large dark circle 186, is moved to the right for sharp overpull and the left for flat overpull. For very large pitch raises, over around 10 to 25 cents, it is useful to turn the spinner rotation off, and view it simply as a circle. See, for example, FIG. 15 where the target has been moved to the right for a sharp overpull pitch raise tuning.

The invention of the present application gives the tuner almost unlimited choices in deciding what tuning style to use. The tuner can match the tuning style to his/her own preferences, or to the piano being tuned, or to the customers preferences, see FIG. 8. Ten standard pre-programmed tuning styles, three narrow styles 196, three medium styles 198, three stretched styles 200, provide varying degrees of octave, double octave, and even triple octave stretch. The styles range from the very clean sounding, beatless or almost beatless style which is the left most of the narrow tuning styles 196 through the fifth tuning style, which is about the average style of most tuners and is the middle one of the medium styles 198, to the very wide octave tuning style which is the right most of the stretched styles 200.

The tenth style or Registered Piano Technicians (RPT) exam style 202 is a special style set up just to pass or give the Piano Technicians Guild tuning exam for Registered Piano Technicians. The RPT style is similar to style number five with A7 tuning set to halfway between the single and double octaves, very conservative/narrow.

Figure 14:
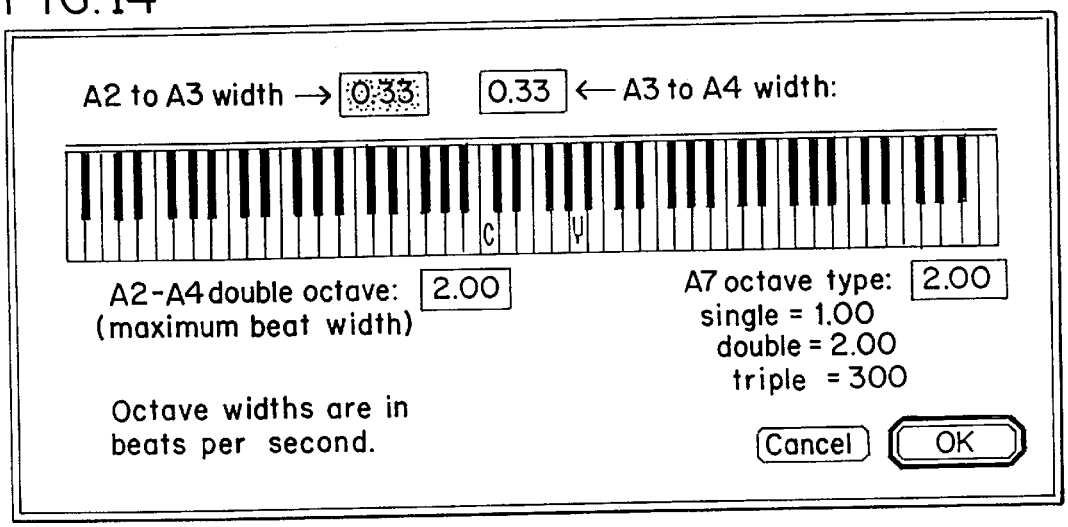
FIG. 14 illustrates a pull-down screen available in a C program which performs the tuning operations of the present invention and permits customization of the tuning operations performed.

The "Custom" style 204 permits the user to directly determine the numbers which are used to calculate the tuning, see FIG. 14 which is a pull-down screen available in a C program which permits customization of the tuning operations of the present invention by the user. The custom style 204 is for advanced users.

| | |
|---|---|
| Tuning Style 1 | (left most of narrow styles 196) |
| T = 0.16 | A3–A4 beats, used up the treble too |
| B = 0.16 | A2–A3 beats, used down the bass |
| Dmax = 0.74 | maximum A2–A4 beats |
| A7_oct = 1.33 | How sharp to tune A7 |
| Tuning Style 2 Conservative | (middle of narrow styles 196) |
| T = 0.20 | |
| B = 0.20 | |
| Dmax = 0.80 | |
| A7_oct = 1.50 | |
| Tuning Style 3: | (right most of narrow styles 196) |
| T = 0.24 | |
| B = 0.24 | |
| Dmax = 0.86 | |
| A7_oct = 1.67 | |
| Tuning Style 4: | (left most of medium styles 198) |
| T = 0.28 | |
| B = 0.28 | |
| Dmax = 0.93 | |
| A7_oct = 1.83 | |
| Tuning Style 5: Moderate | (middle of medium styles 198) |
| T = 0.33 | |
| B = 0.33 | |
| Dmax = 1.00 | |
| A7_oct = 2.00 | |
| Tuning Style 6: | (right most of medium styles 198) |
| T = 0.38 | |
| B = 0.38 | |
| Dmax = 1.06 | |
| A7_oct = 2.16 | |
| Tuning Style 7: | (left most of stretched styles 200) |
| T = 0.44 | |
| B = 0.44 | |
| Dmax = 1.14 | |

-continued

| | |
|---|---|
| A7_oct = 2.33 | |
| Tuning Style 8: Liberal | (middle of stretched styles 200) |
| T = 0.50 | |
| B = 0.50 | |
| Dmax = 1.20 | |
| A7_oct = 2.50 | |
| Tuning Style 9: | (right most of stretched styles 200) |
| T = 0.57 | |
| B = 0.57 | |
| Dmax = 1.27 | |
| A7_oct = 2.67 | |
| Tuning Style 10: Exam | (RPT exam 202) |
| T = 0.33 | |
| B = 0.33 | |
| Dmax = 0.75 | |
| A7_oct = 1.5 | |

As shown in FIG. 14, the user can set three temperament widths that change the tuning style the width of the two single octave widths (T and B), the double octave width (Dmax). The user can also change the A7 octave type. Note that the triple octave (3.00) may be just an expanded double octave (DOUBLE_PLUS). The practical upper and lower limits for T and B are 0.00 to 2.00 beats (hertz), and 0.00 to 4.00 beats for Dmax. The A7 octave type can be between 1.0 and 3.0.

When the tuning system of the present application is finished calculating a tuning, it places the actual values of T and B (T_ACTUAL, B_ACTUAL) and Dmax (D_ACTUAL) into the "header" or description of the tuning for the user to check by ear, and make sure that the tuning matches the piano as predicted.

Having thus described the invention of the present application in detail and by reference to preferred embodiments thereof, it will be apparent that modifications and variations are possible without departing from the scope of the invention defined in the appended claims.

What is claimed is:

1. A method for graphically and dynamically displaying a pitch difference of an unknown pitch relative to a desired pitch, said method comprising the steps of:

determining an unknown pitch;

comparing said unknown pitch to a desired pitch to determine a pitch difference;

displaying a spinner at a center of a display if said pitch difference is within a first defined pitch window relative to said desired pitch;

maintaining said spinner stationary if said pitch difference is equal to zero;

rotating said spinner clockwise if said pitch difference is greater than zero but less than an upper boundary of said first defined pitch window;

rotating said spinner counterclockwise if said pitch difference is less than zero but greater that a lower boundary of said first defined pitch window;

setting the rate of rotation in proportion to the extent said unknown pitch is different than zero;

moving said spinner in a first direction off of said center if said pitch difference exceeds said upper boundary of said first defined pitch window;

moving said spinner in a second direction off said center if said pitch difference exceeds said lower boundary of said first defined pitch window; and setting the amount of movement of said spinner proportional to the extent said unknown pitch exceeds said upper and lower boundaries of said first defined pitch window.

2. A method for graphically and dynamically displaying a pitch difference of an unknown pitch relative to a desired pitch as claimed in claim 1 further comprising the step of modifying said spinner toward a solid image as said unknown pitch increasingly exceeds said upper and lower boundaries of said first pitch window.

3. A method for graphically and dynamically displaying a pitch difference of an unknown pitch relative to a desired pitch as claimed in claim 2 further comprising the step of forming said spinner to comprise at least one sector of a circle and wherein said step of modifying said spinner comprises filling said circle as said unknown pitch increasingly exceeds said upper and lower boundaries of said first pitch window.

4. A method for graphically and dynamically displaying a pitch difference of an unknown pitch relative to a desired pitch as claimed in claim 3 further comprising the step of shrinking said spinner as it is moved from said center.

5. A method for graphically and dynamically displaying a pitch difference of an unknown pitch relative to a desired pitch as claimed in claim 3 further comprising the step of fully filling said circle as said unknown pitch exceeds upper and lower boundaries of a second pitch window.

6. A method for graphically and dynamically displaying a pitch difference of an unknown pitch relative to a desired pitch as claimed in claim 5 wherein said second pitch window is approximately 100 cents in width.

7. A method for graphically and dynamically displaying a pitch difference of an unknown pitch relative to a desired pitch as claimed in claim 5 wherein said first pitch window is approximately 4 cents in width.

8. A method for graphically and dynamically displaying a pitch difference of an unknown pitch relative to a desired pitch as claimed in claim 1 further comprising the step of selectively setting the speed of rotation of said spinner in proportion to the pitch difference in hertz or cents.

9. A method for graphically and dynamically displaying a pitch difference of an unknown pitch relative to a desired pitch, said method comprising the steps of:

determining an unknown pitch;

comparing said unknown pitch to a desired pitch to determine a pitch difference;

moving a macro-tuning pitch spinner linearly to positions indicating macro-tuning of said pitch difference; and controlling motion of a micro-tuning pitch spinner to indicate micro-tuning of said pitch difference.

10. A method for graphically and dynamically displaying a pitch difference of an unknown pitch relative to a desired pitch as claimed in claim 9 further comprising the step of displaying a work area including said positions.

11. A method for graphically and dynamically displaying a pitch difference of an unknown pitch relative to a desired pitch as claimed in claim 9 wherein said step of controlling motion of a micro-tuning pitch spinner comprises the step of moving said micro-tuning pitch spinner along a path.

12. A method for graphically and dynamically displaying a pitch difference of an unknown pitch relative to a desired pitch as claimed in claim 9 wherein said step of controlling motion of a micro-tuning pitch spinner comprises the step of moving said micro-tuning pitch spinner at varying speeds.

13. A method for graphically and dynamically displaying a pitch difference of an unknown pitch relative to a desired pitch as claimed in claim 9 wherein said step of controlling motion of a micro-tuning pitch spinner comprises the step of moving said micro-tuning pitch spinner about a given location.

14. A method for graphically and dynamically displaying a pitch difference of an unknown pitch relative to a desired pitch as claimed in claim 9 wherein said step of moving said micro-tuning pitch spinner about a given location comprises the step of rotating said micro-tuning pitch spinner.

15. A method for graphically and dynamically displaying a pitch difference of an unknown pitch relative to a desired pitch as claimed in claim 9 wherein said step of controlling motion of a micro-tuning pitch spinner comprises the steps of:

moving said micro-tuning pitch spinner along a path; and moving said micro-tuning pitch spinner about locations located along said path.

16. A method for graphically and dynamically displaying a pitch difference of an unknown pitch relative to a desired pitch as claimed in claim 9 further comprising the step of combining said macro-tuning pitch spinner and said micro-tuning pitch spinner.

17. A method for graphically and dynamically displaying a pitch difference of an unknown pitch relative to a desired pitch, said method comprising the steps of:

determining an unknown pitch;

comparing said unknown pitch to a desired pitch to determine a pitch difference;

indicating macro-tuning of said pitch difference within macro-tuning pitch limits by performing the steps of:

displaying a work area spanning said macro-tuning pitch limits; and moving a macro-tuning pitch spinner linearly to positions within said work area which positions indicate macro-tuning of said pitch difference; and indicating micro-tuning of said pitch difference within micro-tuning pitch limits by performing the step of controlling motion of a micro-tuning pitch spinner to indicate micro-tuning of said pitch difference.

18. A method for graphically and dynamically displaying a pitch difference of an unknown pitch relative to a desired pitch as claimed in claim 17 further comprising the step of selecting said macro-tuning pitch limits to be approximately 55 cents flat to 55 cents sharp.

19. A method for graphically and dynamically displaying a pitch difference of an unknown pitch relative to a desired pitch as claimed in claim 17 further comprising the step of selecting said micro-tuning pitch limits to be approximately 25 cents flat to 25 cents sharp.

20. A method for graphically and dynamically displaying a pitch difference of an unknown pitch relative to a desired pitch as claimed in claim 17 wherein said step of controlling motion of a micro-tuning pitch spinner comprises the step of moving said micro-tuning pitch spinner along a path.

21. A method for graphically and dynamically displaying a pitch difference of an unknown pitch relative to a desired pitch as claimed in claim 17 wherein said step of controlling motion of a micro-tuning pitch spinner comprises the step of moving said micro-tuning pitch spinner at varying speeds.

22. A method for graphically and dynamically displaying a pitch difference of an unknown pitch relative to a desired pitch as claimed in claim 17 wherein said step of controlling motion of a micro-tuning pitch spinner comprises the step of moving said micro-tuning pitch spinner about a given location.

23. A method for graphically and dynamically displaying a pitch difference of an unknown pitch relative to a desired pitch as claimed in claim 22 wherein said step of moving said micro-tuning pitch spinner about a given location comprises the step of rotating said micro-tuning pitch spinner.

24. A method for graphically and dynamically displaying a pitch difference of an unknown pitch relative to a desired pitch as claimed in claim 17 wherein said step of controlling motion of a micro-tuning pitch spinner comprises the steps of:

moving said micro-tuning pitch spinner along a path; and moving said micro-tuning pitch spinner about locations located along said path.

25. A method for graphically and dynamically displaying a pitch difference of an unknown pitch relative to a desired pitch, said method comprising the steps of:

determining an unknown pitch;

comparing said unknown pitch to a desired pitch to determine a pitch difference;

displaying a macro-tuning indication representative of said pitch difference within macro-tuning pitch limits by performing the steps of:

displaying a macro-tuning window;

displaying a macro-tuning pitch spinner; and moving said macro-tuning pitch spinner linearly and said macro-tuning window relative to one another to indicate macro-tuning of said pitch difference; and displaying a micro-tuning indication representative of said pitch difference within micro-tuning pitch limits by performing the steps of:

displaying a micro-tuning pitch spinner; and moving said micro-tuning pitch spinner to indicate micro-tuning of said pitch difference.

26. A method for graphically and dynamically displaying a pitch difference of an unknown pitch relative to a desired pitch as claimed in claim 25 wherein said step of moving said macro-tuning pitch spinner and said macro-tuning window relative to one another comprises the step of moving said macro-tuning pitch spinner within said macro-tuning window.

27. A method for graphically and dynamically displaying a pitch difference of an unknown pitch relative to a desired pitch as claimed in claim 26 further comprising the step of combining said macro-tuning pitch spinner and said micro-tuning pitch spinner.

28. A method for graphically and dynamically displaying a pitch difference of an unknown pitch relative to a desired pitch, said method comprising the steps of:

determining an unknown pitch;

comparing said unknown pitch to a desired pitch to determine a pitch difference; and moving a macro-tuning pitch spinner linearly to positions indicating macro-tuning of said pitch differences; and controlling motion of a micro-tuning pitch spinner to indicate micro-tuning of said pitch difference in cents.

* * * * *